United States Patent [19]

Wittmann

[11] 4,214,773

[45] Jul. 29, 1980

[54] HEEL HOLDER FOR RELEASE SKI BINDING

[75] Inventor: Heinz Wittmann, Vienna, Austria

[73] Assignee: TMC Corporation, Baar, Switzerland

[21] Appl. No.: 961,484

[22] Filed: Nov. 17, 1978

[30] Foreign Application Priority Data

Nov. 18, 1977 [AT] Austria ..... 8283/77

[51] Int. Cl.[2] ..... A63G 9/08

[52] U.S. Cl. ..... 280/631

[58] Field of Search ..... 280/626, 628, 631, 632

[56] References Cited

U.S. PATENT DOCUMENTS

| | | | |
|---|---|---|---|
| 3,527,468 | 9/1970 | Berchtold | 280/632 |
| 3,810,644 | 5/1974 | Beyl | 280/632 |
| 4,060,257 | 11/1977 | Jungkind | 280/626 |

FOREIGN PATENT DOCUMENTS

| | | | |
|---|---|---|---|
| 1578835 | 12/1970 | Fed. Rep. of Germany | 280/626 |
| 61440 | 4/1968 | German Democratic Rep. | 280/626 |

*Primary Examiner*—John J. Love
*Assistant Examiner*—Norman L. Stack
*Attorney, Agent, or Firm*—Blanchard, Flynn, Thiel, Boutell & Tanis

[57] ABSTRACT

A heel holder for release ski bindings having a hold-down device pivotally secured to a base plate slidably mounted on a guide rail fixedly secured to the upper surface of the ski. The hold-down device has an internal cam surface thereon which is engaged by a locking member urged into engagement with the cam surface by a release spring. The force generated by the release spring is adjustable to a desired amount to hold the ski boot onto the ski with the desired amount of yieldable force. A manually operated release mechanism is provided for effecting a release of the ski boot from the ski without necessitating a compression of the release spring. The release mechanism includes a lever pivotally supported on the base plate and effects a pivotal movement of a locking pawl to move same out of engagement with a spring fork member also pivotally secured to the base plate about the same pivot axle as is the hold-down device. The locking pawl is resiliently urged into the locking position by a thrust spring separate from the release spring. The release mechanism is operable either by an upward or downward movement applied to the release lever.

10 Claims, 8 Drawing Figures

FIG. 1A
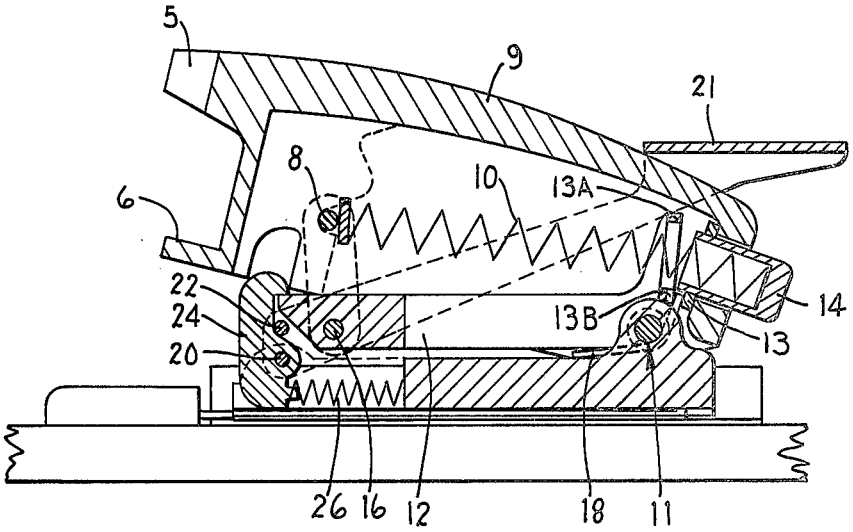
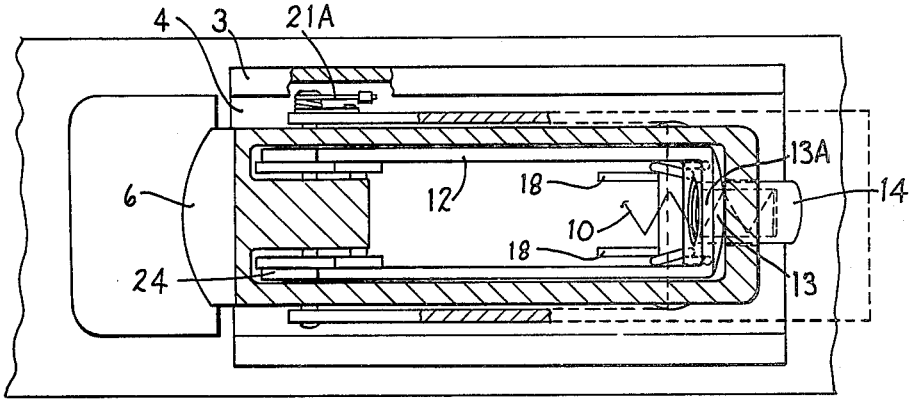
FIG. 2A

HEEL HOLDER FOR RELEASE SKI BINDING

FIELD OF THE INVENTION

The invention relates to a heel holder for release ski binding having a hold-down device which can be closed by a stepping-down procedure and at least one spring which can be tensioned during the stepping-down procedure, whereby a locking member which is loaded by the spring is provided for the engaging position when the binding is closed and a releasing device which can be operated against the force of a further spring is provided for resisting an arbitrary and manual opening of the binding.

BACKGROUND OF THE INVENTION

A heel holder of the above-mentioned type is described for example in DL Pat. No. 61 440. In this known construction, aside from the release spring, a separate torsion spring acts onto a swingable lock, which on the one hand effected the safety release during an overload sliding along a substantially vertical wall and on the other hand facilitates the arbitrary and manual opening of the heel holder operated by a handle. The substantially vertical wall is thereby curved in direction of the sole holder at its end which does not face the upper side of the ski, so that the swivel lock, when the heel pivots due to an overload against the force of the release spring about an axis which lies substantially transversely with respect to the longitudinal axis of the ski, experiences a swivelling against the direction of the swivelling of the entire heel holder, and the swivel lock disengages from a nose, by which it is gripped under in the downhill position, and the heel holder opens. In the case of a manual opening, the handle is operated, and then the heel holder itself first remains in the downhill position and only when the swivel lock has disengaged from the nose (against the force of the torsion spring) can the skier easily step with his ski boot out of the binding. Furthermore, two further springs are provided, through which the ski boot is held clamped in the entire safety ski binding.

A disadvantage of this known construction consists in, even though in particular the main spring is responsible for a safety release, (the torsion spring plays only a subordinate role), the swivel lock, however, being responsible for both the safety release—as a control element—and also for the manual opening—as a releasable locking element. This situation is disadvantageous because the two operations are exposed to entirely different force relationships, and asking one single element to solve both tasks leads automatically to a compromising solution. In this reference, this compromise consists particularly in having to accept large friction forces and furthermore, in the utilization of the two thrust springs, possibly leading to unintended release operations, for example in the case of a bending of the ski.

In a heel holder according to Swiss Pat. No. 505 631, at least one pivotal pawl is provided for locking the spring, which upon reaching a predetermined lifted-off path of the heel holder, is released for disengagement. The pawl is thereby constructed with two arms, and the one end has an abutting surface and serves as a holding hook, and the other end is provided as a stop on a control element for the manual opening, and the control element forms a part of the heel holder. Furthermore, this heel holder has a multimesh linkage, of which one of the member serves as a base frame and one as a hold-down device. The manual opening of this heel holder occurs, according to a product which is manufactured according to this reference, after two steps, namely when first the switch lever is pulled up for example with the ski pole, then the hold-down device has been swung into an intermediate position, then the switch lever is again closed in order to finally enable the heel holder to swing into the highest position, in which the ski boot is released from the clamped position.

Even if in this known construction a certain separation of a release spring and an opening spring (this spring is the spring which biases the switch lever) exists, then this heel holder can again be stepped down only against the force of the main spring both after a manual release and also after a safety release. Since this type of stepping in demands much force, it is disadvantageous, because each type of stepping in can take place only against the force of the release spring. A further disadvantage lies in the above-described opening operation, which, in particular after a difficult fall, can result in additional injuries. Also the utilization of a linkage, which consists of a number of levers, with the joints connected thereto is disadvantageous, in particular the expenditure and wear appearances. However, it must be remarked that this heel holder can be used for both downhill skiing and also for the cross-country skiing.

In a different known construction according to German OS No. 1 728 476, a multimesh linkage is also provided, in which an opening is caused by changing the individual hingedly connected levers with respect to one another, and for the manual opening also in this case the force of the release spring is to be overcome. The aforementioned disadvantageous occur therefore also in the embodiment according to this solution.

The purpose of the invention is now to provide a solution to the above-mentioned disadvantages and to carry out in a heel holder of the above-mentioned type the manual release against the force of a different spring which is independent from the release spring and is substantially weaker with respect to same.

The set purpose is inventively attained by the locking member with the associated release spring and the releasing device for effecting the manual opening with the spring which is associated with it each forming a separate system.

Through the inventive construction, only the force of a practically constant thrust spring must be overcome during a manual opening, which spring force is substantially less than the force of the release spring. The thrust spring has now the purpose to hold the ski boot between the two ski binding parts under a certain initial tension, however, the release spring takes on practically the entire safety function. According to size, the relationship between the two forces is approximately 1:1, 5 to 5, and in addition it must be assured that the force of the release spring increases during a manual release operation, so that the above statements are yet more unfavorable for a manual release against the force of the release spring.

A particularly preferable embodiment of the invention consists in that as a releasing device a release lever, which can be pivoted against the force of at least one thrust spring, is provided and cooperates with at least a pivotal pawl, whereby the pawl in the downhill skiing position of the heel holder holds down the entire housing member above a frame part, which, loaded by a further spring, is released during operation of the release lever and during closing of the binding, after a manual opening, is stepped down by the skier only against the force of the thrust spring.

In this manner it is assured that the heel holder, during a manual opening, must be operated only against the force of the thrust spring and is stepped down by the skier also during closing only against this spring force.

A still further inventive characteristic consists in a spring fork being provided as a base-frame part, the free ends of which fork are remote from the pivot axis therefor, and can each engage a pivotal pawl, which pawls in turn are each spring biased by a thrust spring. In this manner, a structure which is symmetrical with respect to the longitudinal axis of the heel holder is secured, and the lateral arrangement of the structural parts which can be closed together gives the designer a free hand with respect to the inner design of the heel holder.

A still further inventive solution is that the pivotal pawl is loaded by a thrust spring, and the holding hook engages in the closed position of the heel holder a frame part, which forms in turn a spring abutment for the release spring, and that the hold-down device can be pivoted about an axis which extends transversely with respect to the longitudinal axis of the ski, which axis in turn is supported in the base frame. The control element is constructed as a release lever which is pivotal about an axis which extends parallel to the pivot axis and has an operating element, which in the rest position of the release lever rests on the pivotal pawl and in the pivoted position of the release lever holds the pawl against the force of the thrust spring in a position pivoted about the axis, whereby the holding hook disengages from the base frame.

BRIEF DESCRIPTION OF THE DRAWINGS

Further inventive solutions, details and advantages of the invention are described more in detail with reference to the drawings, which illustrate several exemplary embodiments.

In the drawings

FIG. 1 is a central longitudinal sectional view taken along the line I—I in FIG. 2, FIG. 1A is a central longitudinal sectional view similar to FIG. 1 but with the heel holder moved to the automatically released position thereof, FIG. 2 is a top view of FIG. 1, FIG. 2A is a partially sectioned top view taken along the line IIA–IIA of FIG. 1, FIG. 3 is a cross-sectional view taken along the line III—III of FIG. 1 and FIG. 4 illustrates a position after a manual opening of the heel holder which is illustrated in FIG. 11

DETAILED DESCRIPTION

Figure 1:
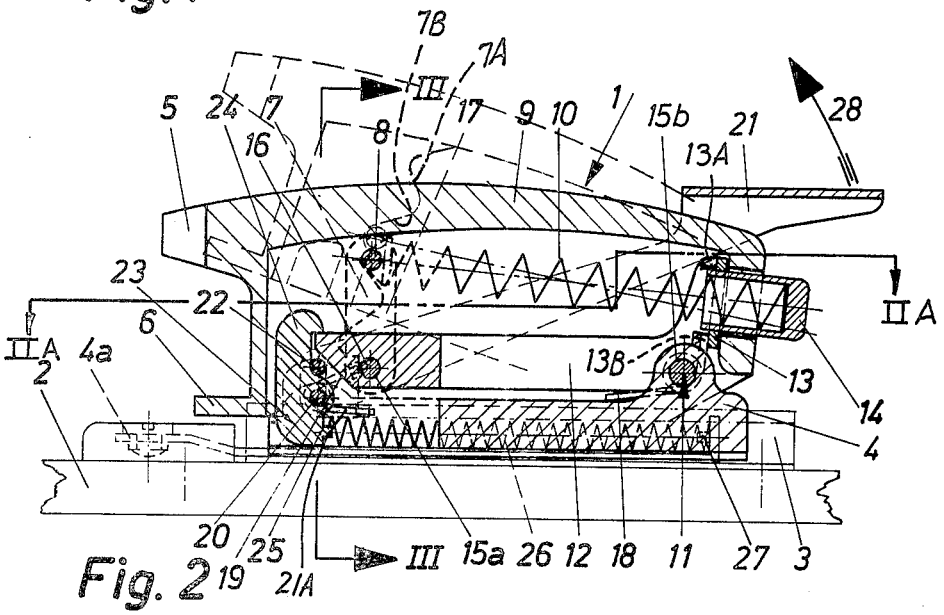
FIGS. 1 to 4 illustrate a first embodiment of the inventive heel holder having a release lever which opens pursuant to a pulling thereon, where
Figure 2:
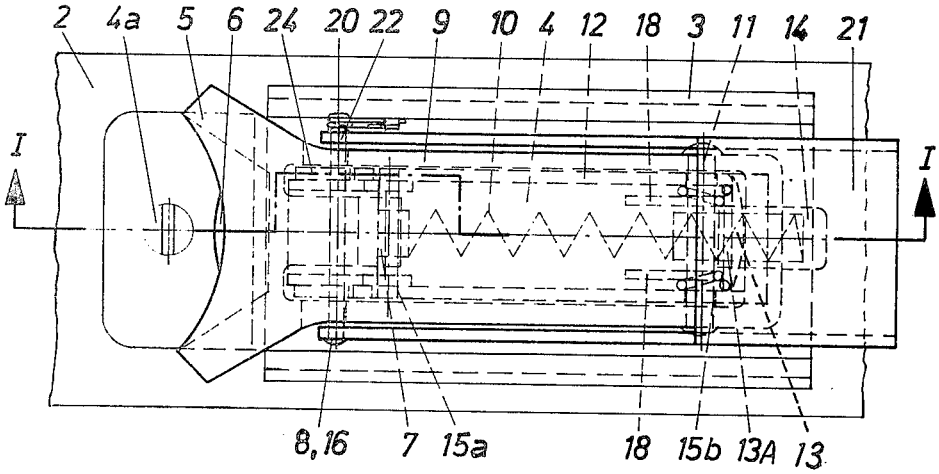
Figure 3:
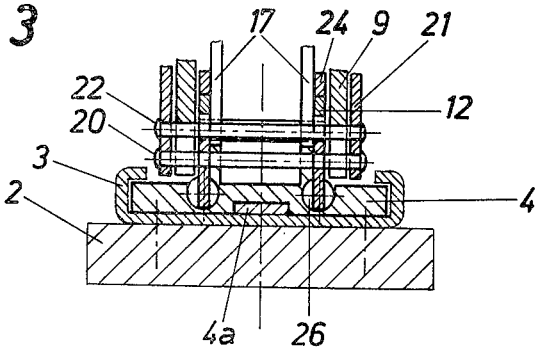

In the first embodiment according to FIGS. 1 to 4, as is particularly shown in FIGS. 1 and 2, a heel holder which is identified as a whole by the reference numeral 1 is mounted by means of a rail 3 on a ski 2. The rail 3 is secured on the ski 2 by means of screws which are only schematically indicated by center lines therefor. The heel holder 1 is held in the desired position in relationship to the rail 3 through a bearing block 4 slidably mounted on the rail 3 and maintained in position by means of a detent 4*a*. The bearing block 4 can be moved, as is shown in particular in FIG. 3, in longitudinal direction of the ski between guideways of the rail 3. A pivot axis or axle 11 is provided in the bearing block 4, which axis extends substantially at a right angle with respect to the longitudinal axis of the ski and functions as a bearing for a housing member 9. The housing member 9 has a hold-down device 5 and a spur 6, which structural parts serve in a conventional manner for holding down the ski boot for downhill skiing and for facilitating a stepping into the heel holder 1. The housing member 9 has a cam 7 therein, on which cam rests a control bolt 8 which is biased by a release spring 10. The control bolt 8 extends substantially parallel to the pivot axis 11 and is supported in a pair of laterally spaced plate 17. The pair of plates 17 has a separate not-illustrated bearing point for one end of the release spring 10, whereas the other end of the release spring lies in a cavity in an adjusting screw 14, which screw in turn is threadedly engaged with a nut 13 which is urged into engagement with the inside rear wall surface of the housing 9 by the force of the springs 10 and 18 is supported also on the pivot axis 11 which serves as a bearing; it is constructed approximately U-shaped in a top view, and the web or bight 13A thereof has a cut-out portion 13B therein to receive one leg of the spring 18 therein. Furthermore, openings 15*a*, 15*b* are provided in the two legs of the U, which are arranged at the front end and at the rear end; a bolt 16 which extends transversely with respect to the longitudinal axis of the ski is provided in the openings 15*a*, on which bolt are supported the pair of plates 17, the openings 15*b* are axially aligned with the pivot axis 11. Through the latter, the spring fork 12 and the pivot axis 11 are pivotally swingably supported. A pivotal pawl 23, which will be described more in detail hereinbelow, engages each of the free ends of the two legs of the spring fork 12, which free ends are remote from the pivot axis 11.

The two pivotal pawls 23 are arranged on an axle 20, which extends transversely with respect to the longitudinal axis of the ski and substantially parallel with respect to the pivot axis 11. In place of one common axle, it is also possible to provide separate axially aligned axles, for example in the form of two axially aligned rivets. A release lever 21 which is constructed approximately U-shaped in a top view thereof is swingably supported on the same axle 20 and biassed by a torsion spring 21A to the position shown in FIGS. 1 and 1A. The two pivotal pawls 23 each have a hook at their areas remote from the ski 2 through which the free ends of the spring fork 12 are held down in the position of use of the heel holder 1 in the position which is illustrated in full lines in FIG. 1 (as a frame part). At the ends which face the ski 2, the two pivotal pawls 23 each have a spring abutment 25, on each of which one thrust spring 26 is supported. The other end of each thrust spring 26 is supported on a spring abutment 27 which is remote from the spring abutments 25. The release lever 21 has in its area which faces the two pivotal pawls 23 a bolt 22, which extends transversely with respect to the longitudinal axis of the ski and which rests in the closed position of the heel holder 1 on the two pivotal pawls 23. An opening spring 18 is wound around the pivot axle 11 in the form of a torsion spring. This assures that after an automatic or manual opening, the heel holder 1 is resiliently held in the opened position. Thus stepping in can occur without any additional operation of the heel holder 1.

The heel holder will, however, be closed for transport purposes. For opening of the closed heel holder 1, the release lever 21 in turn must be operated in the direction of the arrow 28. The operation of the manual opening and closing will be discussed in detail below.

As one can take from FIG. 1, the housing member 9 assumes after an automatic opening the position which is indicated in this figure in broken lines. This position is provided in the same figure in order to inndicate that thereby, namely during an automatic release operation, the two pivotal pawls 23 remain in engagement with the spring fork 12 and only the housing member 9 is pivoted with the hold-down device 5 and the spur 6 against the force of the release spring 10 about the pivot axis 11, and the control bolt 8 is moved along the surface of the cam 7. It can also be recognized that as long as the control bolt 8 moves relative to the cam 7 on the rising surface 7A of said cam (in FIG. 1 this surface 7A is the control surface which extends inclined from the top left to the bottom right), the housing member 9 holds the not-illustrated ski boot elastically resiliently in the clamped-in position within this area. As soon as the cam 7 has moved the control bolt 8 against the force of the release spring 10 during an opening movement to the dead-center position (not identified separately), the limit of the elasticity has been exceeded and the control bolt 8 now moves along the surface 7B of the cam 7 (from the top right to the bottom left), and the release spring 10 is relaxed and the housing member 9 is moved about the pivot axis 11 due to the action of the opening spring 18 into the position which is illustrated with dashed lines in FIG. 1. It is repeatedly pointed out that the frame part of the heel holder, which part is formed substantially by the spring fork 12 and by the two pivotal pawls 23 remain thereby in the closed position.

Figure 4:
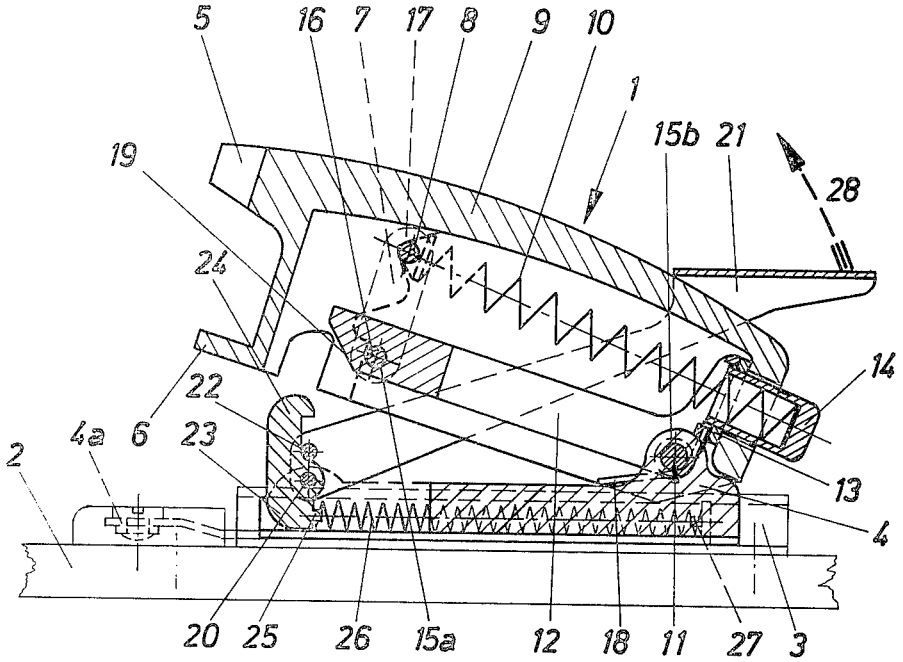

If, however, the heel holder 1 is to be opened manually by means of the release lever 21 in direction of the arrow 28, then through this operation a pivoting movement of the release lever 21 about the axis 20 is performed. The bolt 22 presses thereby on the two pivotal pawls 23, so that same pivot about the axis 20 and against the force of the two thrust springs 26, and the two hooks 24 disengage from the ends of the respectively associated leg of the spring fork 12. Since now no resistance stands against the pivoting of the spring fork 12 about the pivot axis 11, due to the action of the opening spring 18, same together with the two plates 17 and also together with the housing member 9 are pivoted with an unchanged release-spring force, and with respect to these structural parts, the position which is illustrated in FIG. 4 is assumed. As soon as the release lever 21 is released after the manual opening has taken place, the thrust springs 26 press the two pivotal pawls 23 pivoting about the axis 20 again into the position which corresponds to the closed position, whereby, however, in this case the two hooks 24 do not grip any area of the spring fork 12 and the two pivotal pawls 23 assume an "empty" position according to FIG. 4. Also the release lever 21 is illustrated in the released position (at rest position). This is therefore the position after a manual opening has taken place.

If now the heel holder 1 is to be closed by stepping in, then the sliding surfaces 19 on the spring fork 12 become active and slide along the slightly rounded-off surfaces of the two hooks 24 on the pivotal pawls 23 and cause due to the thereby-created power components between said structural parts a pivoting of the pawls 23 about the axis 20, whereby this pivoting is carried out in turn against the force of the two thrust springs 26. After the heel holder 1 is closed, again the position which is shown in full lines in FIG. 1 is created, and the two pivotal pawls 23 are in engagement with the spring fork 12.

The top view which is shown in FIG. 2 does not contain any additional structural parts, this figure serves only the purpose of providing a better and complete understanding of the inventive solution according to the first exemplary embodiment.

Figure 5:
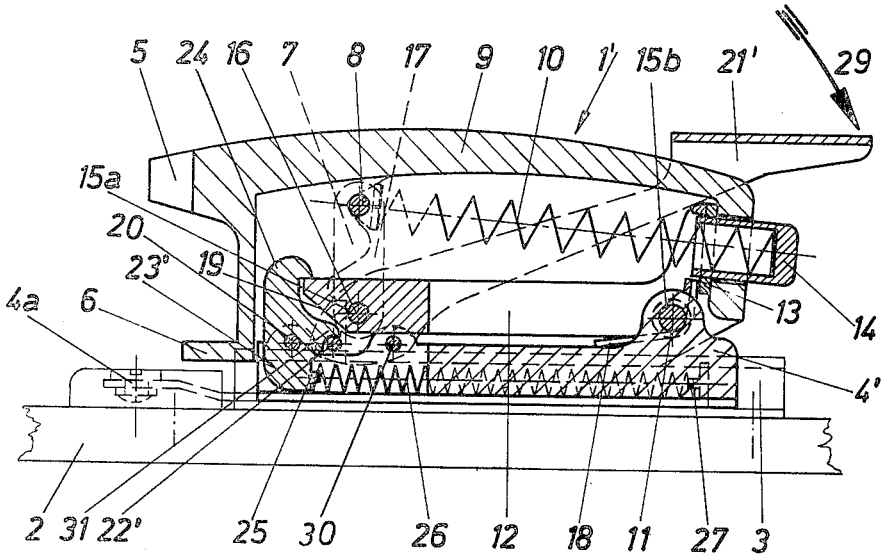
FIG. 5 illustrates a further example having a release lever which opens to a downward pushing thereon.

The second exemplary embodiment according to FIG. 5 shows a heel holder 1' with a release lever 21' which can be operated by a pushing force. Moreover, the structural parts which are identical with the structural parts which have been described in the first exemplary embodiment are identified with the same reference numerals, only those structural parts which have a different design are identified with a prime (′). Additional structural parts receive a separate reference numeral designation.

The release lever 21' according to the second exemplary embodiment according to FIG. 5 is supported on a king pin 30 which is independent from the axis 20, which king pin in turn is arranged in the bearing block 4' parallel with the axis 20. The king pin 30 is moved in relationship to the axis 20 in the longitudinal direction of the ski in direction of the pivot axis 11, so that the area of the release lever 21', which extends in direction of the two pivotal pawls 23', can receive the bolt 22' at a corresponding distance from the king pin 30, which bolt 22' can in the closed postion of the heel holder 1' be gripped over by further hooks 31 on the two pivotal pawls 23'. If the release lever 21' is now pressed downwardly in direction of the arrow 29, then the front part of the release lever 21' is swung upwardly with the bolt 22', and the further hooks 31 are driven through a pivoting motion about the axis 20, and the two pivotal pawls 23' are again pivoted against the force of the two thrust springs 26, so that the housing member 9 opens in the manner described in connection with the first exemplary embodiment. The closing again is done by the action of the sliding surfaces 19 on to the roundedoff outer surfaces of the hook areas of the two pivotal pawls 23'.

Figure 6:
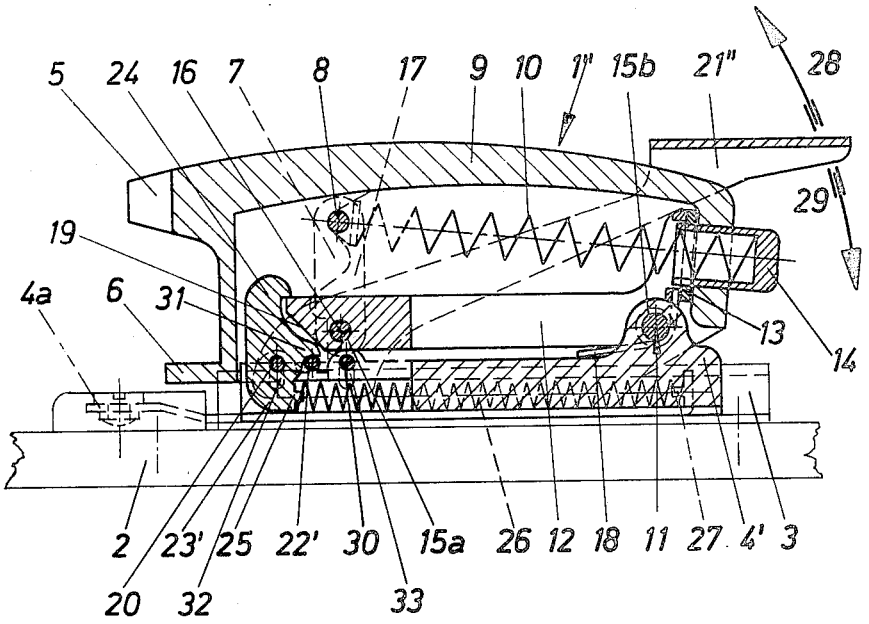
FIG. 6 is still a further exemplary embodiment, in which the release lever reacts both to an upward pulling force and also to a downward pushing force.

In the third exemplary embodiment according to FIG. 6, the release lever 21" is supported on a king pin 30 similar to the embodiment according to FIG. 5 and also the support of the two pivotal pawls 23' takes place about the axis 20. A difference consists only in the provision of slotted holes 32 and 33 each being associated with two bearing points on the release lever 21". In the closed position of the heel holder 1", the release lever 21" lies with the upper ends of the two slotted holes 32 and 33 on the associated bearing points, namely on the axis 20 and on the king pin 30.

If now the release lever 21" is loaded through a pulling or upward lifting motion to effect an automatic opening for example in direction of the arrow 28, then the release lever 21" is supported with the upper edge of the slotted hole 32 engaging the axis 20, whereas the slotted hole 33 in relation to the king pin 30 is swivelled upwardly, and the bolt 22' swivels the further hooks 31 upwardly and the manual opening takes place in the same manner as described in FIG. 5. If, however, the release lever 21" is pressed downwardly in direction of the arrow 29 (stressed with pressure), then the release lever 21" is supported with the upper edge of the slotted hole 33 engaging the king pin 30, whereas now a swivelling due to the upward movement of the slotted hole 32 in relation to the axis 20 can take place and the bolt 22', loading the further hooks 31, effects the manual opening in the already described manner. Therefore, the release lever 21" carries out a kind of a rocking movement, and this rocking is carried out always about an end point (axis 20 or king pin 30) of the bearing and the bolt which effects the opening is moved always in the same direction (upwardly).

Top views for the embodiments according to FIGS. 5 and 6 are not needed in view of the otherwise corresponding design described in the first exemplary embodiment.

The invention is not limited to the illustrated exemplary embodiments. Further modifications are possible without departing from the scope of the invention. Thus, it is for example possible to exchange with one another axes, king pins, rivets and the like, and it is also possible to place one common pawl in the place of two pivotal pawls, in particular when for this the spring fork is constructed accordingly. Also in place of the through-going bolt for the operation of the pawls, it is possible to provide for the release lever axially aligned axles or a shoulder or extension. It is also conceivable to permit a suitable dimensioned spring to load the release lever, in order to hold same always in the blocked position. As a result, a vibration of the release lever is avoided, which otherwise can lead to annoying noises.

It is also conceivable to let the release spring cooperate with a differently designed cam, for example such that the cam is provided on a separate swivellable part, and a nose of the housing member cooperates with the cam. However, it is also conceivable to construct the cam in the cavity of the housing member and to provide between the cam and the release spring a swivellable structural part with a nose, which rests on the cam. This embodiment can be advantageous in connection with the first subject matter of the invention in particular when for an increased separation of base frame and holddown device use of a further structural part appears to be advantageous.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A heel holder of a safety ski binding, comprising:
elongated rail means mounted on a ski;
bearing block means mounted on said rail means;
housing means pivotally secured to said bearing block means and being movable between a ski boot holding position and a ski boot releasing position about a first axis extending perpendicular to said longitudinal axis of said ski, said housing means having first means thereon for engaging the heel portion of a ski boot;
pawl means pivotally secured to said bearing block means about a second pivot axis parallel to said first axis, said pawl means having a hook thereon;
an intermediate member pivotally secured to said bearing block means and movable about a third pivot axis parallel to said first pivot axis, said intermediate member having second means thereon operatively engageable with said hook on said pawl means;
first resilient means for urging said hook on said pawl means into engagement with said second means on said intermediate member;
second resilient means for urging said intermediate member away from said pawl means about said third pivot axis in response to a release of the engagement between said hook on said pawl means and said intermediate member;
control means, including a release spring, for controlling the pivotal movement of said housing means about said first pivot axis in response to external forces applied thereto;
connecting means for operatively connecting said intermediate member to said control means for facilitating a simultaneous pivotal movement of said intermediate member and housing means about said first and third pivot axes in response to a release of the engagement between said hook on said pawl means and said intermediate member, said connecting means also permitting a pivotal movement of said housing means about said first pivot axis relative to said intermediate member in response to an external force which is sufficient to overcome said release spring and when said intermediate member remains engaged with said pawl means; and
manually operable release lever means pivotally secured to said bearing block means for manually effecting a pivoting of said pawl means against the force of said first resilient means to unlatch said hook from engagement with said intermediate member to permit said second resilient means to effect the simultaneous movement of said intermediate member and said housing means to said boot releasing position.

2. The heel holder according to claim 1, wherein said bearing block means is slidably mounted on said rail means, wherein said first resilient means extend between said rail means and said pawl means and effect the simultaneous urging of said pawl means into engagement with said intermediate member and said bearing block means toward the tip of said ski.

3. The heel holder according to claim 1, wherein said first and third pivot axes are coaxial.

4. The heel holder according to claim 1, wherein said pawl means includes two pawls each having a hook thereon;
wherein said first resilient means includes two thrust springs extending between said rail means and said pawls and parallel to the longitudinal axis of said ski;
wherein said intermediate member is a bifurcated member having two arms and a bight portion, the free ends of each of said arms being operatively releasably engageable with said hook on each of said pawls.

5. The heel holder according to claim 4, wherein said bight portion has an opening therein through which extends said release spring.

6. The heel holder according to claim 4, wherein each of said pawls has a first control surface thereon;
wherein each of said arms has a second control surface thereon, said second control surfaces each contacting said first control surface during a forced movement of said intermediate member toward said pawls to effect a retracting of said hooks to thereby facilitate a movement of said free ends of said arms therepast after which said thrust spring urges said hooks into latching relation with said free ends of said arms.

7. The heel holder according to claim 1, wherein said release lever means includes a lever having a bolt thereon movable therewith, said bolt engaging said pawls in response to a pivoting of said lever to effect a movement of said hooks away from said free ends of said arms.

8. A heel holder according to claim 7, wherein said lever is U-shaped having a pair of parallel legs, each of said legs being pivotally secured to said bearing block means about said second pivot axis.

9. The heel holder according to claim 8, including a further spring for urging said lever to its initial position whereby a manual force applied thereto must overcome the force of said further spring and said thrust springs to effect an unlatching of said hooks from engagement with said free ends of said arms.

10. The heel holder according to claim 7, wherein said lever has a pair of elongated slots therein;

wherein said bearing block means has a pair of longitudinally spaced bearing members each received in one of said slots, said bearing members being located on opposite sides of said bolt whereby said lever is responsive to manual force applied in both directions to effect a pivotal movement of said pawls against the urging of said thrust springs.

* * * * *